US010041309B2

(12) United States Patent
Bruandet

(10) Patent No.: US 10,041,309 B2
(45) Date of Patent: Aug. 7, 2018

(54) QUICK RELEASE DOWN-THE-HOLE HAMMER DRILL BIT ASSEMBLY

(71) Applicant: SANDVIK INTELLECTUAL PROPERTY AB, Sandviken (SE)

(72) Inventor: Olivier Bruandet, Tampere (FI)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 230 days.

(21) Appl. No.: 15/112,634

(22) PCT Filed: Dec. 11, 2014

(86) PCT No.: PCT/EP2014/077444
§ 371 (c)(1),
(2) Date: Jul. 19, 2016

(87) PCT Pub. No.: WO2015/110217
PCT Pub. Date: Jul. 30, 2015

(65) Prior Publication Data

US 2016/0340983 A1 Nov. 24, 2016

(30) Foreign Application Priority Data

Jan. 21, 2014 (EP) ..... 14151865

(51) Int. Cl.
*E21B 4/14* (2006.01)
*E21B 10/36* (2006.01)
*E21B 17/07* (2006.01)

(52) U.S. Cl.
CPC ..... *E21B 17/076* (2013.01); *E21B 4/14* (2013.01); *E21B 10/36* (2013.01)

(58) Field of Classification Search
CPC ... E21B 4/06; E21B 4/14; E21B 10/36; E21B 1/00; E21B 17/076
See application file for complete search history.

(56) References Cited

U.S. PATENT DOCUMENTS 6,789,632 B2 * 9/2004 Green ..... E21B 17/076 173/133
7,117,939 B1 10/2006 Hawley et al.
2010/0263932 A1 10/2010 Wolfer

FOREIGN PATENT DOCUMENTS

| | | | |
|---|---|---|---|
| EP | 1757769 | A1 | 2/2007 |
| GB | 2385869 | A | 9/2003 |
| WO | 9805476 | A1 | 2/1998 |
| WO | 2008005113 | A2 | 1/2008 |
| WO | 2009023930 | A1 | 2/2009 |
| WO | 2009124051 | A2 | 10/2009 |
| WO | 2013104470 | A2 | 7/2013 |

* cited by examiner

*Primary Examiner* — Catherine A Loikith
(74) *Attorney, Agent, or Firm* — Conne R. Gorski

(57) ABSTRACT

A quick release down-the-hole (DTH) hammer drill bit assembly includes a drill bit releaseably retained at a drive transmission component (drive sub) via a retaining sleeve and respective retaining formations to axially couple and lock the drill bit at the assembly. In particular, the drill bit is retained exclusively at the assembly via retaining formations at the drive sub, the sleeve and the drill bit, without a requirement for additional retaining rings that would otherwise axially lock the drill bit at the drive sub.

15 Claims, 7 Drawing Sheets

QUICK RELEASE DOWN-THE-HOLE HAMMER DRILL BIT ASSEMBLY

RELATED APPLICATION DATA

This application is a § 371 National Stage Application of PCT International Application No. PCT/EP2014/077444 filed Dec. 11, 2014 claiming priority of EP Application No. 14151865.4, filed Jan. 21, 2014.

FIELD OF INVENTION

The present invention relates to a percussive drill assembly and in particular, although not exclusively, to a down-the-hole hammer assembly in which a drill bit is axially coupled to a drive component via a quick-release coupling arrangement that allows rapid and convenient axial detachment of the drill bit from the drive component.

BACKGROUND ART

The technique of down-the-hole (DTH) percussive hammer drilling involves the supply of a pressurised fluid via a drill string to a drill bit located at the bottom of a bore hole. The fluid acts to both drive the hammer drilling action and to flush rearwardly dust and fines resultant from the cutting action, rearwardly through the bore hole so as to optimise forward cutting.

Typically, the drill assembly comprises a casing extending between a top sub and a drill bit that, in turn, is releaseably coupled to a drive component (commonly referred to as a chuck or drive sub). Drilling is achieved via a combination of rotation and axial translation of the drill bit. Rotation is imparted to the drill bit from the drive sub via intermediate engaging splines. The axial percussive action of the bit is achieve via a piston that is capable of shuttling axially between the top sub and the drill bit and is driven by the pressurised fluid to strike a rearward anvil end of the bit. A foot valve extends axially rearward from the drill bit to mate with the piston during its forwardmost stroke to control both the return stroke and provide exhaust of the pressurised fluid from the drill head that acts to flush rearwardly the material cut from the bore face. Example DTH hammer drills are described in WO 2008/051132 and WO 2013/104470.

Conventionally, the drill bit is retained at the assembly and in contact with the drive sub via a retaining ring accommodated within the assembly. However, due to the significant loads imparted to the drill bit, it is common for the drill bit head to shear from the bit shank. This disrupts drilling operation significantly as boring cannot be resumed until the detached bit head is recovered as it otherwise represents an impenetrable barrier to forward drilling and would in turn significantly damage a replacement drill bit. GB 2385869; US 2010/0263932; WO 2009/124051 and U.S. Pat. No. 7,117,939 disclose DTH drive couplings that attempt to retain a detached or 'shanked' drill head at the assembly so that the head may be retracted with the drill string to avoid retrieval problems. In particular, a retaining sleeve extends axially between the drive sub and the bit head to 'catch' and retain the head in the event of detachment.

However, these conventional drive coupling arrangements are disadvantageous for a number of reasons. Fundamentally, as a result of the magnitude of the torque transmitted between the drive sub and the hammer casing, it is typically very difficult to remove the drive sub and 'break-open' the assembly without dedicated tooling that may not be available on-site. The arrangements of the prior art are typically focussed towards detached bit head retention and in turn compromise the ease and time required for removal and installation of a replacement drill bit that typically requires a partial dismantling of the assembly.

A further problem with conventional coupling assemblies is the accelerated wear of all or part of the coupling components that may in turn accelerate wear of or cause damage to other components of the assembly. In particular, the retaining sleeves described in GB 2385869 and US 2010/0263932 are rotatably locked at the drive sub. Due to the configuration of these couplings, the worn components cannot be replaced without breaking-open the drive sub and encountering the aforementioned problems. Accordingly, there exists a need for a drill bit coupling arrangement that addresses the above problems and provides for the convenient and rapid removal and installation of a replacement drill bit at the drive assembly.

SUMMARY OF THE INVENTION

It is an objective of the present invention to provide a drive coupling for a percussive drill assembly in which a drill bit is releaseably retained at a rotational drive component of the assembly via an arrangement that allows both convenient and rapid interchange of replacement drill bits without having to dismantle or decouple additional and unnecessary components forming part of the assembly. It is a further specific objective to provide a coupling arrangement in which the coupling components are isolated, as far as possible, from the transmission of torque between the drive components and the drill bit and/or the compressive and tensile forces resultant from the drilling hammer action.

The objectives are achieved via i) a retaining sleeve positioned around and extending axially between the drill bit and the drive transmission component (referred to herein as a 'drive sub') that is isolated from the rotational torque forces during use and ii) respective retaining connections (alternatively termed retaining formations herein) provided at the drive sub, the sleeve, and the drill bit. The formations axially couple and lock the drill bit at the assembly whilst allowing convenient and rapid axial decoupling of the bit (via an axial forward separation of the drill bit from the assembly) without having to decouple the drive sub from the remainder of the assembly, typically the piston casing. In particular, the retaining formations further allow the convenient and rapid decoupling of the retaining sleeve at the drive sub via a corresponding axially forward decoupling motion. According to the specific implementations, this axial detachment of the drill bit and sleeve is achieved via a simple rotation of the sleeve and/or drill bit relative to the remainder of the assembly. In particular, the present objectives are achieved as the drill bit is coupled to the drive sub exclusively by the retaining formations present at the drive sub, the retaining sleeve and drill bit. That is, the present coupling arrangement is devoid of any additional bit retaining component, including for example collars, rings, split rings, washers and the like that would otherwise act to trap axially the drill bit at the assembly as are common to the conventional coupling arrangements of the type described in GB 2385869 and US 2010/0263932. Additionally, the present sleeve arrangement comprises retaining formations that may be conveniently disengaged from the drive sub via an axial forward decoupling movement of the sleeve relative to the drive sub. This is in contrast to the aforementioned retaining assemblies in which the sleeve comprises respective abutment regions at its rearward end that engage the drive sub and allow decoupling exclusively via movement of the sleeve in the opposite axially rearward direction towards the drill string.

Accordingly conventional drive subs are required to be decoupled from the drill string in order to allow this.

According to a first aspect of the present invention there is provided a down-the-hole hammer drill assembly having an axially forward cutting end and an axially rearward attachment end for coupling to a drill string, the assembly comprising a drill bit positioned at the cutting end having a cutting head and a shank, a radially outward facing part of the shank comprising first retaining connections, an elongate casing to provide a housing for a piston capable of shuttling back and forth axially to strike a rearward anvil end of the shank; an annular drive sub provided at an axially forward end of the casing, the shank accommodated and extending axially through the drive sub, a radially outward facing part of the drive sub comprising second retaining connections; a retaining sleeve having a first end positioned over a part of the shank and a second end positioned over a part of the drive sub, the sleeve comprising third and fourth retaining connections at radially inward facing parts to cooperatively engage respectively the first and second retaining connections to axially couple the drill bit to the drive sub; characterised in that the first and third connections are configured to disengage one another axially and allow axial decoupling of the drill bit from the sleeve via an axially forward movement of the drill bit relative to drive sub; the second and forth connections are configured to disengage one another axially and allow axial decoupling of the sleeve from the drive sub via an axially forward movement of the sleeve relative to the drive sub; such that the axial coupling of the drill bit to the drive sub is provided exclusively via the engagement between the respective first and third and second and forth retaining connections.

Optionally, a radially outward facing part of the drive sub comprises fifth retaining connections and a radially inward facing part of the casing comprises sixth retaining connections that cooperatively engage the fifth retaining connections and releaseably couple axially the drive sub to the casing. Such an arrangement is advantageous to allow interchange of a worn drive sub having a different service lifetime to the retaining sleeve and the drill bit.

According to the subject invention, the axial disengagement of the first and third and the second and forth retaining connections is possible without a requirement to axially decouple the fifth and sixth retaining connections. Accordingly, the subject invention is advantageous to avoid the need for dedicated tooling to break-open the drive sub and casing and to allow quick and convenient interchange of worn drill bits on-site by drill operation personnel. That is, the drill bit may be readily decoupled via a simple rotation and an axial sliding motion.

Additionally, the present sleeve arrangement is advantageous to allow independent axially forward decoupling of the sleeve as the sleeve wear rate is typically greater than the drive sub and hence service personnel need not dismantle the drive sub unnecessarily. This is achieved as at least a part of the fourth and optionally the second retaining connections are 'open' in the axially forward direction to allow a rearward end of the sleeve to pass axially over an axially forward end of the drive sub during coupling and decoupling.

Optionally the first and third retaining connections comprise bayonet connections formed as groove and lug arrangements. Optionally, the second and forth retaining connections comprise bayonet connections formed as groove and lug arrangements. Optionally, the first and third retaining connections comprise screw threads. Optionally, the second and forth retaining connections comprise screw threads.

Preferably, each groove comprises a first axially extending channel being closed at each axial end and a second axially extending channel being closed at a first end and open at a second end, the first and second channels spaced apart circumferentially and interconnected by a circumferentially extending passageway, the lug capable of sliding within the passageway and the first and second channels. Such an arrangement represents a bayonet type coupling in which a lug is capable of movement within a grooved profile to provide convenient and rapid decoupling of two components.

Preferably, the components of the assembly comprise a plurality of lugs and grooves distributed circumferentially around a longitudinal axis extending through the assembly.

Preferably, the assembly further comprises first splines provided at a radially outward facing region of the shank and second splines provided at a radially inward facing region of the drive sub to engage the first splines so as to provide transfer of rotational drive from the drive sub to the drill bit.

Optionally, the drill bit is coupled axially to the drive sub exclusively via abutment between each lug and the closed ends of the respective first channels. Accordingly, the sleeve is configured as a wear-part and may be readily interchanged when worn without a requirement to decouple the drive sub from the casing which may typically have a longer service lifetime. Alternatively, the drill bit may be coupled axially to the drive sub exclusively via abutment between each lug and the closed ends of the respective first channels of the first and third connections and between the screw threads of the second and fourth connections.

Advantageously, the present assembly is devoid of any additional retaining ring positioned radially between the casing and the shank to otherwise axially retain the drill bit at the drive sub (such an arrangement being conventional to prior art assemblies). The relative dimensions of the present drill bit, retaining sleeve and drive sub are configured to allow the drill bit to slide axially from the drive sub when the retaining connections are manipulated to respective decoupled states.

According to a second aspect of the present invention there is provided a drilling apparatus for percussive rock drilling comprising a drill string formed from a plurality of end-to-end coupled drill tubes and a drill assembly as claimed herein releaseably attached at an axially forward end of the drill string.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
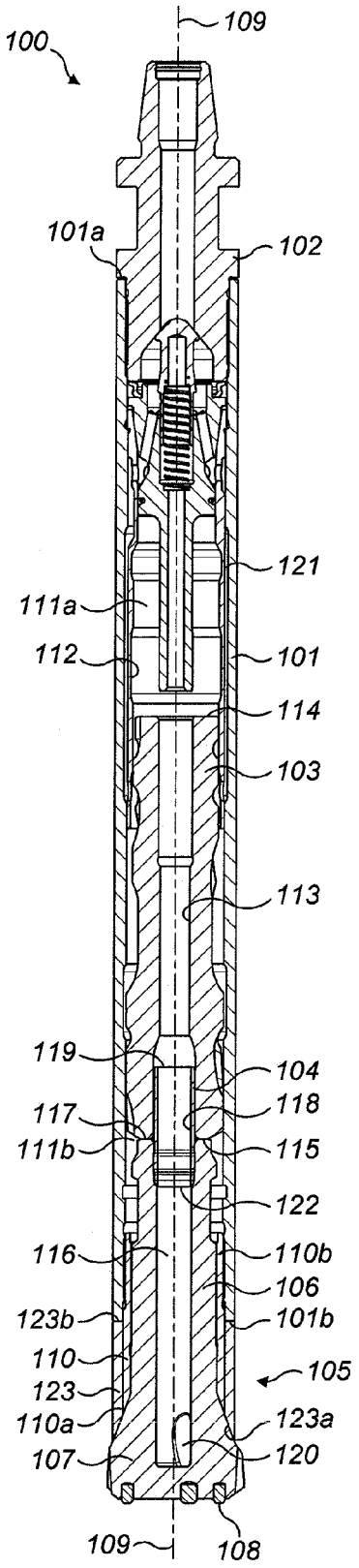
FIG. 1 is an axial cross sectional view of a down-to-ball hammer drill assembly according to a specific implementation of the present invention.

Referring to FIG. 1, a down-the-hole (DTH) hammer drill assembly 100 comprises a substantially hollow cylindrical casing 101 having an axially rearward end 101*a* and an axially forward end 101*b*. A top sub 102 is at least partially accommodated within rearward end 101*a* of casing 101 whilst a drill bit 105 is at least partially accommodated within the casing forward end 101*b*. Drill bit 105 comprises an elongate shaft 106 having internal passageway 116. A drill bit head 107 is provided at a forward end of shaft 106 and comprises a plurality of wear resistant cutting buttons 108. An axially rearward face 117 of shaft 106 represents an anvil end of drill bit 105.

A distributor cylinder 121 extends axially within casing 101 and in contact with an inward facing substantially cylindrical casing surface 112 that defines an axially extending internal cavity. An elongate substantially cylindrical piston 103 extends axially within cylinder 121 and casing 101 and is capable of shuttling back and forth along central longitudinal axis 109 extending through the assembly 100. Piston 103 comprises an axially rearward end 114 and an axially forward end 115. An internal bore 113 extends axially between ends 114, 115.

A foot valve 104 projects axially rearward from the anvil end of drill bit shaft 106 and comprises a generally cylindrical configuration having a rearward end 119 and a forward end 122. An internal passageway 118 extends axially between ends 119, 122 in fluid communication with drill bit passageway 116 and piston bore 113. In particular, an axially forward region of foot valve 104 is embedded and locked axially within the rearward anvil end region of drill bit shaft 106. In particular, just over half of the axial length of foot valve 104 extends rearward from anvil end 117.

Casing 101 and distributor cylinder 121 define the internal chamber having an axially rearward region 111*a* and axially forward region 111*b*. Piston 103 is capable of reciprocating axially to shuttle within chamber regions 111*a*, 111*b*. In particular, a pressurised fluid is delivered to drill assembly 100 via a drill string (not shown) coupled to top sub 102. Distributor cylinder 121 and top sub 102 control the supply of the fluid to the chamber regions 111*a*, 111*b*. In particular, and as will be appreciated, with fluid supplied to the axially rearward region 111*a*, piston 103 is forced axially towards drill bit 105 such that the piston forward end 115 strikes bit anvil end 117 to provide the percussive drilling action to the cutting buttons 108. Fluid is then supplied to the forward cavity region 111*b* to force piston 103 axially rearward towards top sub 102. With piston 103 in the axially forwardmost position, foot valve 104 is mated within piston bore 113 to isolate and close fluid communication between drill bit passageway 116 and cavity region 111*b*. As piston 103 is displaced axially rearward, piston end 115 clears foot valve end 119 to allow the pressurised fluid to flow within drill bit passageway 116 and to exit drill bit head 107 via flushing channels 120. Accordingly, the distributed supply of fluid to cavity regions 111*a*, 111*b* creates the rapid and reciprocating shuttling action of piston 103 that, in turn, due to the repeated mating contact with foot valve 104, provides a pulsing exhaust of pressurised fluid at the drill bit head 107 as part of the percussive drilling action.

A drive sub 110 (alternatively termed a drive chuck) is positioned at the cutting end of the assembly 100 and in particular to surround bit shaft 106. Drive sub 110 comprises an axially forward end 110*a* positioned towards bit head 107 and an axially rearward end 110*b* accommodated within an axially forward region of casing 101. The sleeve-like drive sub 110 is mated in contact with the bit shaft 106 via a plurality of inter engaging splines (illustrated in FIG. 2) that extend both axially and radially at a radially outward facing surface 204 of bit shaft 106 and a radially inward facing surface 205 of the drive sub 110. With assembly 100 coupled at an axially forward end of the drill string (not shown) rotational drive to the bit head 107 is transmitted through casing 101 and drive sub 110 to drill bit 105.

Drill bit 105 is retained axially at the assembly 100 via a retaining sleeve 123 that extends around bit shaft 106 and an axially forward region of drive sub 110. In particular, an axially rearward end 123*b* of sleeve 123 is positioned in contact with the casing forward end 101*b* and an axially forward sleeve end 123*a* is positioned in contact with bit head 107.

FIGS. 2 to 5 illustrate the preferred embodiment of the subject invention in which drill bit 105 is axially retained at the assembly 100 by a plurality of retaining formations (provided at the drill bit 105, sleeve 123 and drive sub 110) formed as bayonet-type connections. In particular, an axially rearward region 207 of bit head 107 is substantially cylindrical and comprises a plurality of circumferential distributed grooves. The grooves are divided into a plurality of axially extending channels 202 having closed forward 305 and rearward 304 ends. A circumferentially extending passageway 403 provides communication between each channel 202 and a neighbouring second axially extending channel 401. Channel 401 is closed at an axially forward end 406 but open at an axially rearward end 404.

Similarly, an external surface at an axially forward region of drive sub 110 comprises corresponding grooves represented by a plurality of axially extending channels 203 having closed forward 307 and rearward 306 ends. A passageway 402 provides communication with a second axially extending channel 400 having a closed rearward end 405 and an open forward end 404. Bit channels 202, 401 are aligned co-axially with the respective drive sub channels 203, 400 such that the opened ends 404 of each channel 400, 401 are mated to align as a continuous channel extending from bit head 107 to drive sub 110.

Retaining sleeve 123 comprises a first set of radially extending lugs 200 distributed circumferentially and extending radially inward from an inward facing sleeve surface 500. Lugs 200 are provided at sleeve forward end 123*a*. A corresponding second set of lugs 201 is provided at the axially rearward sleeve end 123*b* with the two sets of lugs 200, 201 aligned at the same circumferential positions at surface 500. Each forward lug 200 is capable of being received and sliding within bit channels 202, 401 and passageway 403.

Similarly, each rearward lug 201 is capable of being received and sliding within drive sub-channels 203, 400 and drive sub passageway 402.

An annular collar 206 projects radially outward from external surface of drive sub 110 and is positioned at an approximate axially mid-region between forward and rearward ends 110*a*, 110*b*. Collar 206 is configured for positioning in near touching contact with the rearward sleeve end 123*b*. Similarly, the axially forward sleeve end 123*a* is configured for positioning in near touching contact with an axially rearward region 310 of bit head 107.

Figure 2:
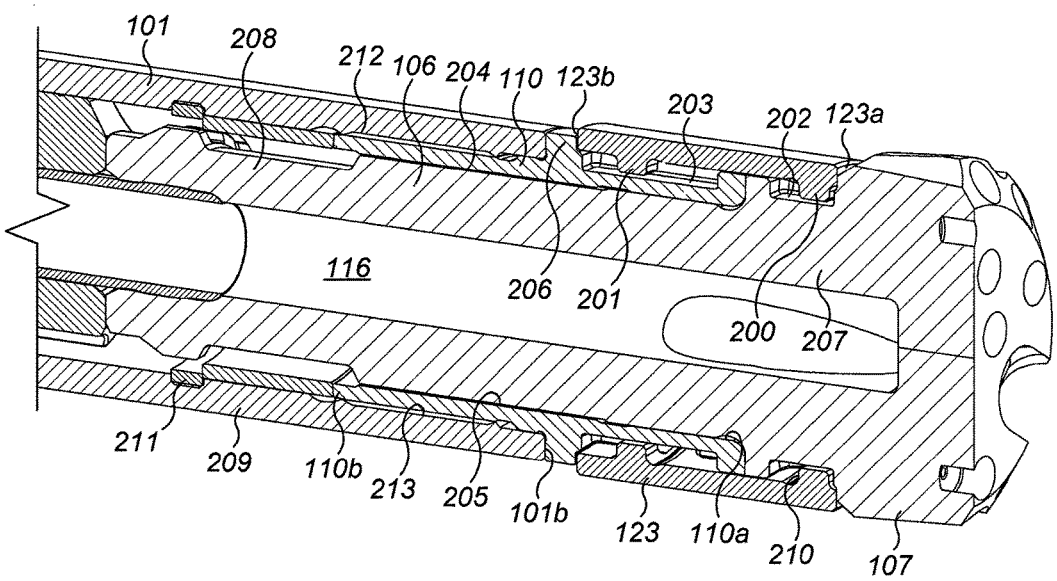
FIG. 2 is a cross sectional perspective view of the drilling end of the drill assembly of FIG. 1 in which the drill bit is retained at the assembly by a retaining sleeve and respective retaining formations provided at the sleeve, a drill bit and a drive sub.

FIG. 2 illustrates the drill bit 105 secured in-position during drilling operation being mated axially in full contact with drive sub 110. That is, rearward sleeve lugs 201 are positioned towards drive sub collar 206. In particular, a rearward lug surface 309 is positioned close to (and optionally in near touching contact with) rearward channel end 306. Similarly, a forward facing surface 311 of forward lugs 200 is mated close to (and optionally in near touching contact with) forward end 305 of channel 202. Such an arrangement is advantageous to provide an axially compact configuration. A radially extending shoulder 301 is provided at the axially forward drive sub end 110*a* and comprises a forward facing annular surface 300. Drive sub end surface 300 is mated in touching contact with the rearward facing annular surface 302 of bit head 107 that is defined by a radially extending annular shoulder 303 formed at an axially rearward end of bit head 107. With the drill bit 105 fully mated axially against the drive sub 110 shown in FIG. 2 (with the drive sub and drill bit shoulders 301, 303 mated in touching contact) sleeve 123 is isolated from the axial compression forces transmitted through drive sub 110 and drill bit head 107. That is, sleeve 123 is not axially locked in position between collar 206 and drill head region 310 and is not placed under load. Lugs 201, 200 are therefore capable of short axial sliding movements within respective channel 203, 202.

Figure 3:
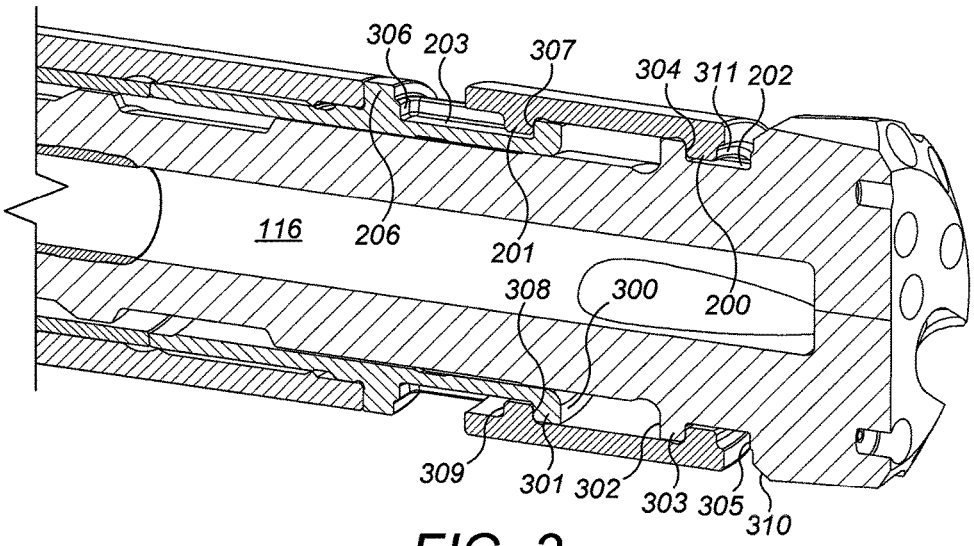
FIG. 3 is a further cross sectional perspective view of the assembly of FIG. 2 with the drill bit illustrated in an axially forward non-drilling position.
Figure 4:
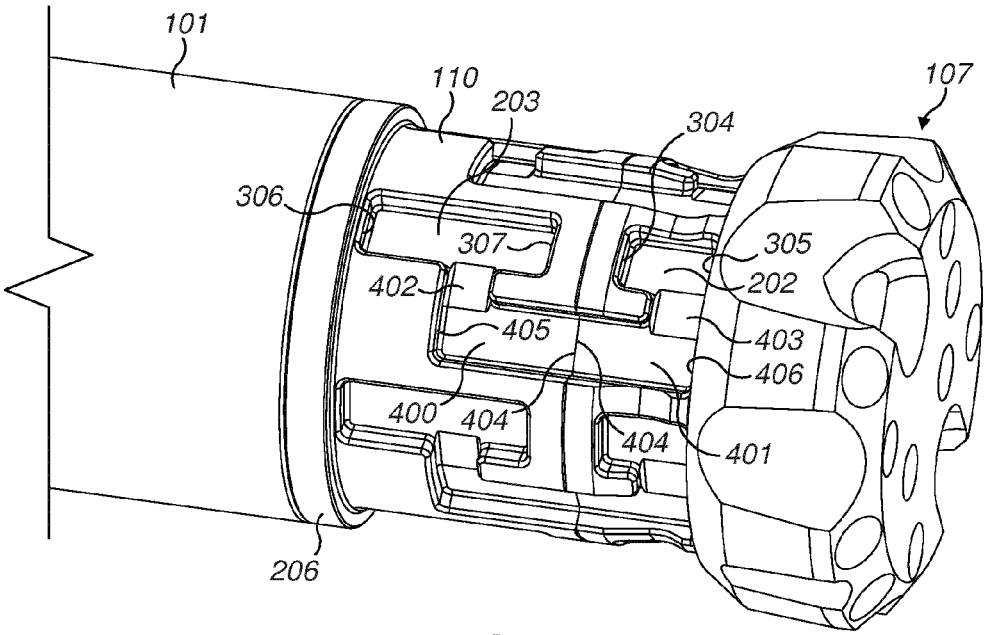
FIG. 4 is an external perspective view of the assembly of FIG. 2, with the retaining sleeve removed for illustrative purposes.
Figure 5:
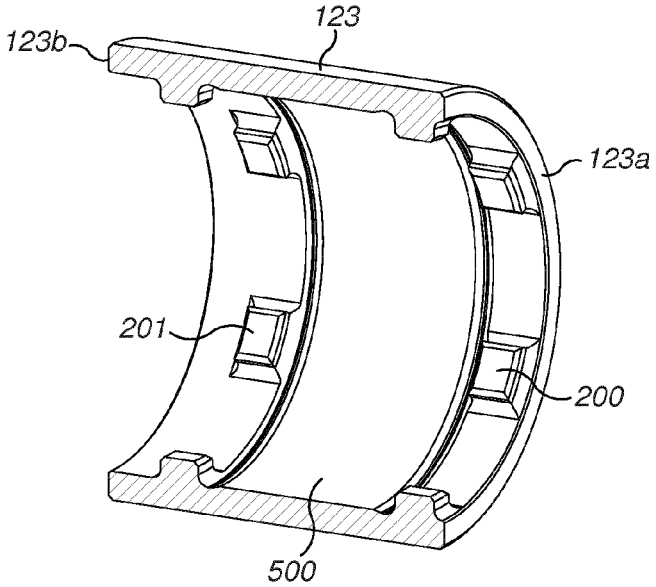
FIG. 5 is a partial cut-away perspective view of the retaining sleeve of FIG. 2.

FIG. 3 illustrates the drill bit 105 in an axially forward-most position relative to drive sub 110. In particular, the drill bit 105 is retained axially at drive sub 110 exclusively via the interaction between channels 202, 203 and the respective lugs 200, 201. For example, when the bit head 107 is lowered downwardly through the bore hole or is retracted rearwardly from the cutting face, drill bit 105 is capable of sliding axially from the position of FIG. 2 to the position of FIG. 3 under gravity. The drill bit head 107 is retained at drive sub 110 as a rear face 210 of each forward lug 200 contacts channel end 304 and a rear facing surface 307 of drive sub shoulder 301 is mated in touching contact with a forward face 308 of each rearward lug 201.

Following drilling operation and with bit 105 in the 'loose' position of FIG. 3, the bit 105 may be conveniently decoupled from assembly 100 by rotation of sleeve 123 about axis 109 such that lugs 200, 201 travel in a circumferential direction from respective channels 202, 203 along passageways 403, 402 to channels 401, 400. Drill bit 105 may then be pulled axially forward to allow lugs 200, 201 to slide out of the respective channels 401, 400 via the respective channel open ends 404.

Importantly, the assembly 100 is devoid of any additional coupling rings, collars, gaskets or retaining components that are conventional within the art and are typically positioned to extend radially between an axially rearward part 208 of bit shaft 106 and a forward region 209 of casing 101. Bit shaft 106 is therefore capable of sliding axially through the drive sub 110 with the lugs 200, 201 positioned within the respective channels 401, 400. In particular, an external diameter of bit shaft 106 is less than an internal diameter of drive sub 110 along the entire axial length of bit shaft 106 and drive sub 110 to allow this axial decoupling.

An annular recess 211 is provided at a radially inward facing surface of casing 101 to retain a piston retaining gasket (not shown) that is configured to prevent piston 103 from falling axially out of casing 101 when drill bit 105 is removed. The piston retaining gasket however does not extend radially onto drill bit shaft 106 which would otherwise prevent the bit 105 from being removed axially forward following rotation of sleeve 123.

According to the embodiment of FIGS. 2 to 5, sleeve 123 is capable of free axial and rotational movement within the respective grooves provided at drill bit 105 and drive sub 110 and is not locked axially or radially at the drill bit 105 or drive sub 110 by additional components.

Figure 6:
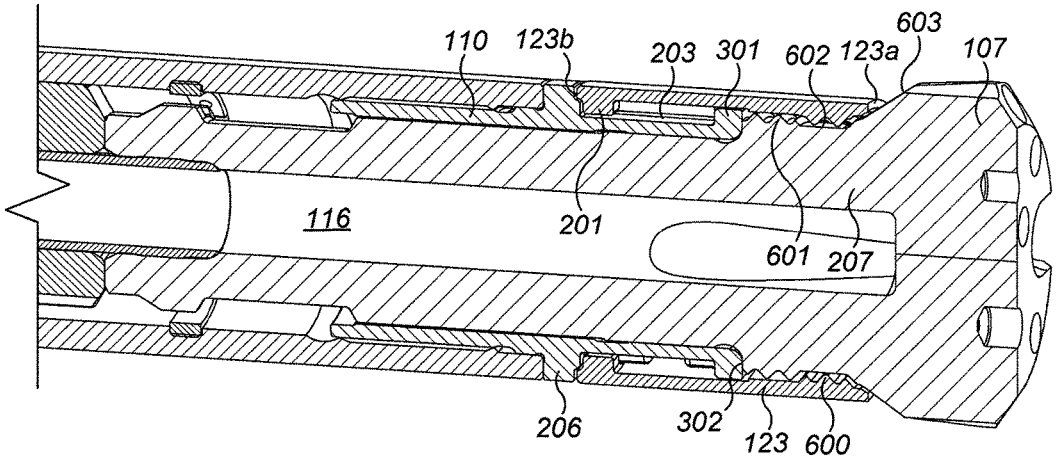
FIG. 6 is a cross sectional perspective view of the drilling end of the drill assembly of FIG. 1 in which the drill bit is retained at the assembly by a retaining sleeve and respective retaining formations provided at the sleeve, a drill bit and a drive sub according to a further specific implementation.
Figure 7:
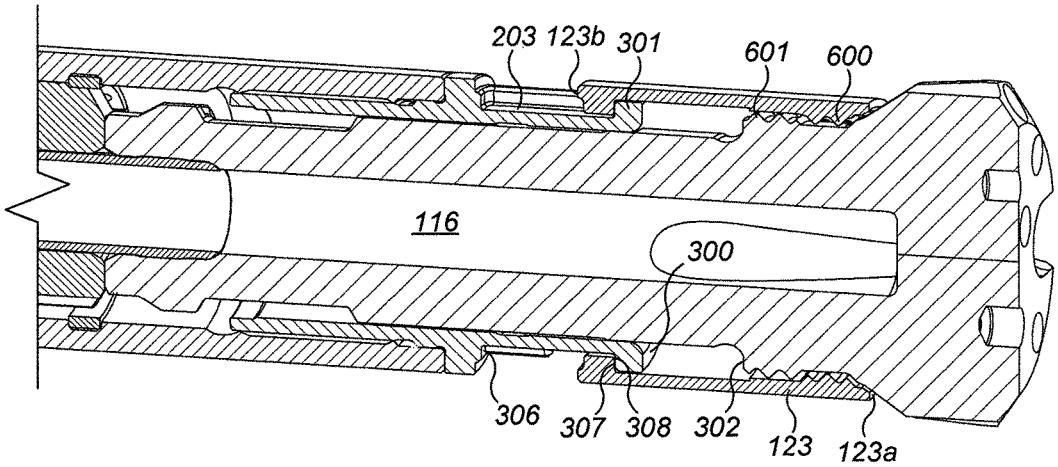
FIG. 7 is a further cross sectional perspective view of the assembly of FIG. 6 with the drill bit illustrated in an axially forward non-drilling position.
Figure 8:
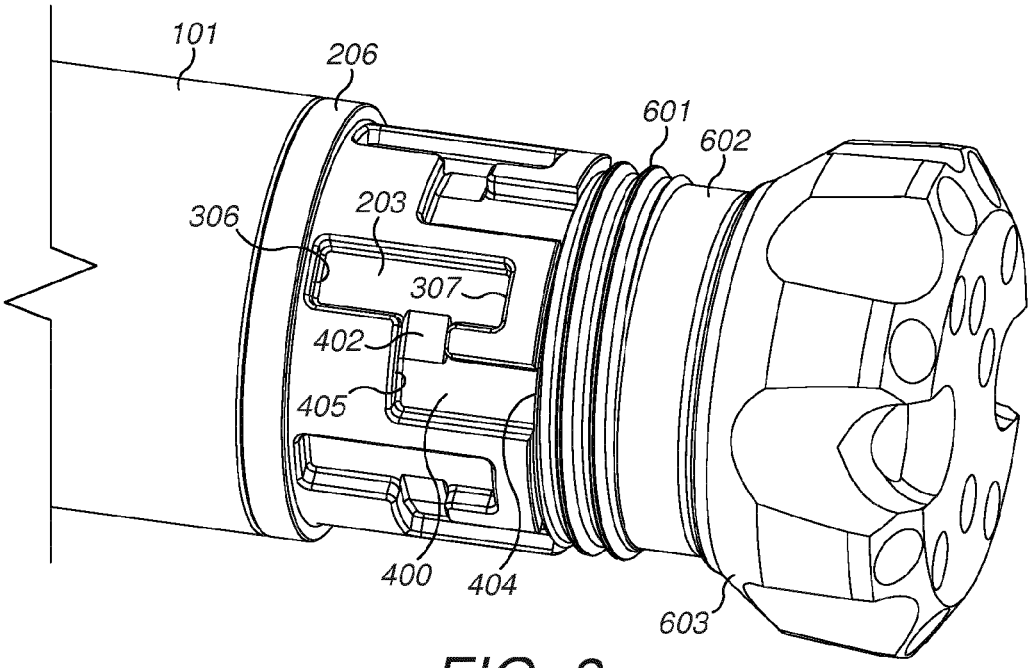
FIG. 8 is an external perspective view of the assembly of FIG. 6, with the retaining sleeve removed for illustrative purposes.
Figure 9:
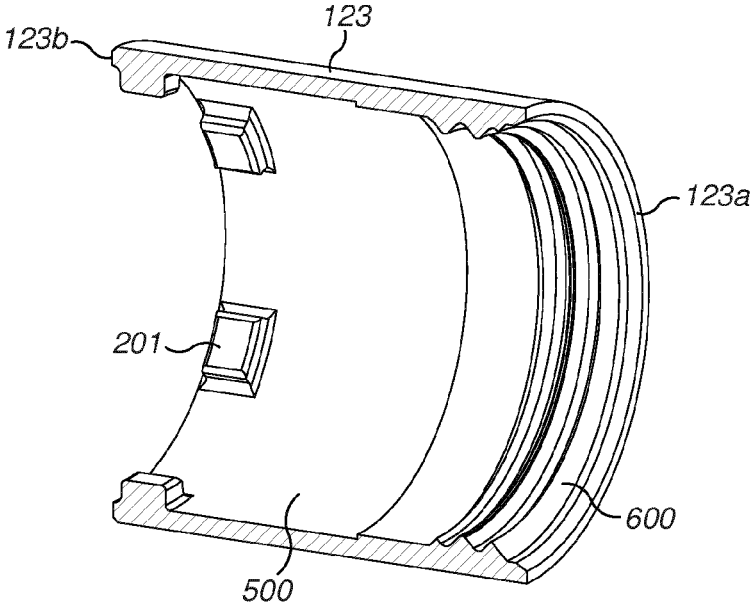
FIG. 9 is a partial cut-away perspective view of the retaining sleeve of FIG. 6.

FIGS. 6 to 9 illustrate a further embodiment of the present invention in which the formations that retain axially the drill bit 105 at the assembly 100 comprise i) screw threads at an axially forward region and ii) bayonet couplings at an axially rearward region. In particular, screw threads 601 are formed at the radially outward facing surface of drill bit region 207 to corporate with corresponding screw threads 600 provided at the internal facing surface 500 of sleeve 123 at a region towards axially forward sleeve end 123*a*. Drill bit threads 601 extend axially forward from annular surface 302 positioned axially at the junction of bit head 107 and bit shaft 106. Threads 601 terminate at an axial position to provide an annular surface region 602 that is devoid of threads 601. With the drill bit 105 fully mated against drive sub 110 as illustrated in FIG. 6, sleeve threads 600 are positioned axially so as to sit over bit surface region 602. The axially forward region of drive sub 110 comprises the circumferentially distributed grooves and channels as detailed referring to the embodiment of FIGS. 2 to 5. Similarly, the axially rearward end of retaining sleeve 123 comprises the same lugs 201 that project radially inward from sleeve inner surface 500. Accordingly, when in a non-drilling state (as illustrated in FIG. 7), bit head 107 is retained axially at drive sub 110 via mating contact between drive sub shoulder 301 with sleeve lugs 201 in addition to mating contact between drill bit threads 601 and sleeve threads 600.

Drill bit 105 may be conveniently decoupled from the assembly 100 firstly via movement of each lug 201 within the respective channels 203, 400 and passageway 402 to decouple the connected sleeve 123 and drill bit 107 from drive sub 110. Secondly, drill bit 107 is the then detached from sleeve 123 by rotating bit 107 about axis 109 to allow threads 601, 600 to decouple via inter-engagement. As with the embodiment of FIGS. 2 to 5, sleeve 123 is isolated from the axial composite forces resultant from piston 103 striking bit shaft 106. This is similarly achieved by the relative axial dimensions (in particular length) of sleeve 123 (and its associated components 600, 201) and the corresponding relative positions of the corresponding retaining formations 601, 203, 400, 402. In particular, the axially forward sleeve end 123*a* is positioned in near touching contact with near bit head rearward region 603 whilst the corresponding rearward sleeve end 123*b* is positioned in near touching contact with drive sub collar 206.

Figure 10:
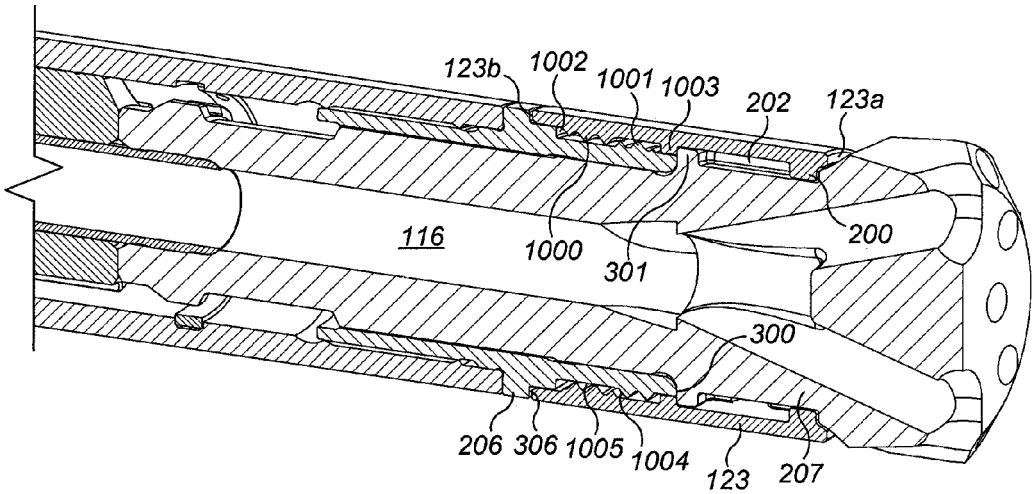
FIG. 10 is a cross sectional perspective view of the drilling end of the drill assembly of FIG. 1 in which the drill bit is retained at the assembly by a retaining sleeve and respective retaining formations provided at the sleeve, a drill bit and a drive sub according to a further specific implementation.
Figure 11:
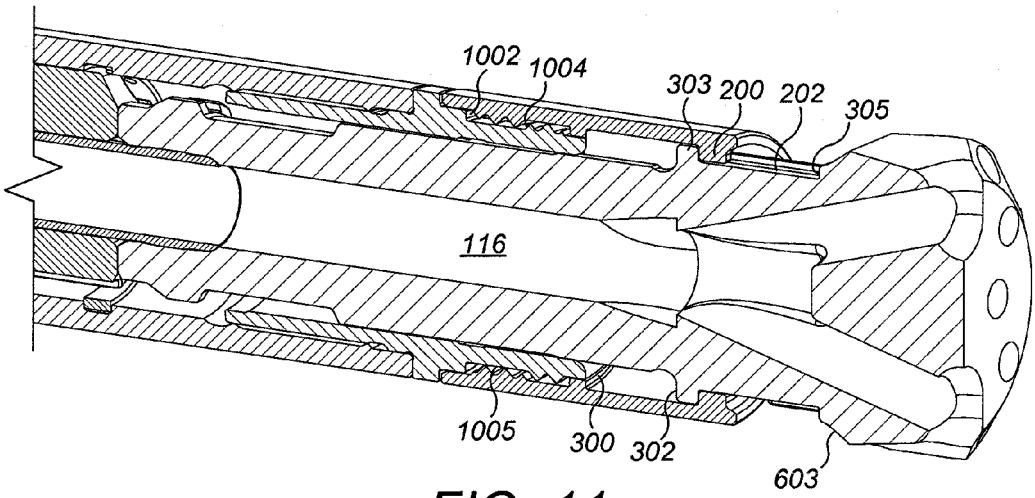
FIG. 11 is a further cross sectional perspective view of the assembly of FIG. 10 with the drill bit illustrated in an axially forward non-drilling position.
Figure 12:
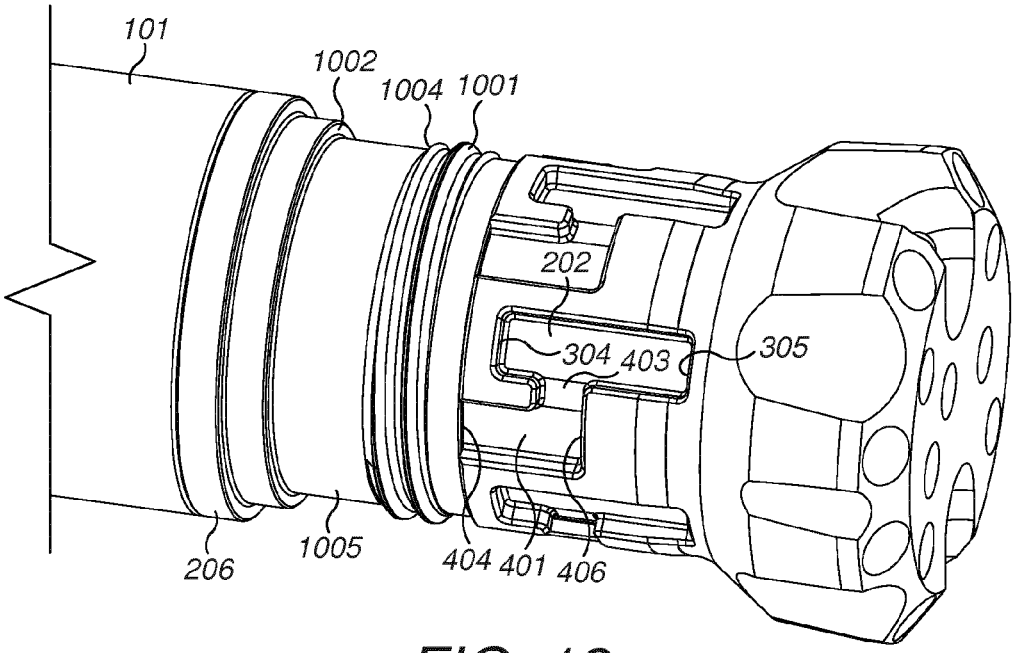
FIG. 12 is an external perspective view of the assembly of FIG. 10, with the retaining sleeve removed for illustrative purposes.
Figure 13:
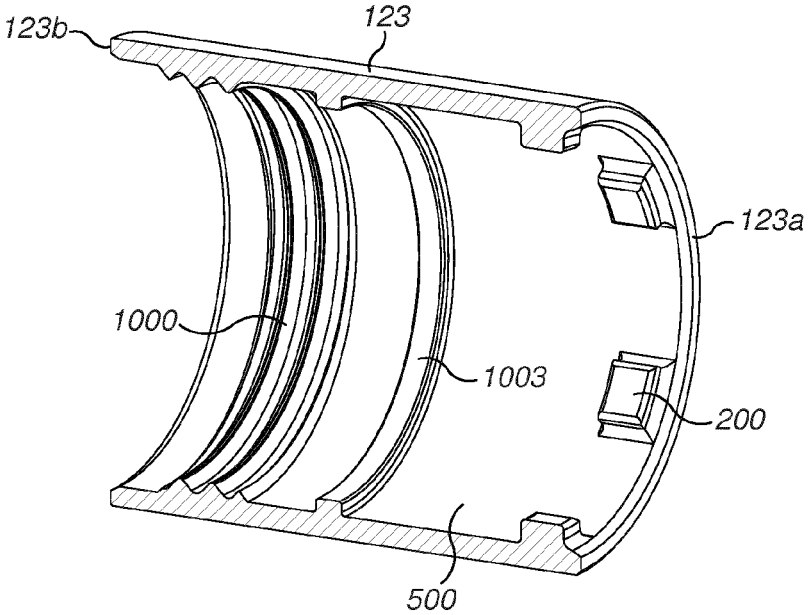
FIG. 13 is a partial cut-away perspective view of the retaining sleeve of FIG. 10.

FIGS. 10 to 13 illustrate a further embodiment of the subject invention that is effectively the reverse configuration of the embodiment of FIGS. 6 to 9 in which the drill bit 105 is retained at the assembly 100 via couplings formed by bayonet-type formations and screw thread formations. According to the further embodiment of FIGS. 10 to 13, screw threads 1001 are provided at a radially outward facing surface of drive sub 110 to extend axially immediately behind the forwardmost annular drive sub face 300. Drive sub threads 1001 terminate axially at region 1005 such that the outward facing drive sub surface region 1005 is devoid of threads 1001. An axially rearward part of surface region 1005 is terminated by an annular shoulder 1002. Corresponding screw threads 1000 are provided at the radially inwardly facing sleeve surface 500 at a position axially towards sleeve rearward end 123*b*. With the drill bit 105 mated fully against drive sub 110 (as shown in FIG. 10), sleeve threads 1000 are positioned over surface region 1005 and are accommodated between thread ends 1004 and shoulder 1002. A collar 1003 projects radially inward from sleeve surface 500 to axially abut drive sub shoulder 301. The axially forward region of sleeve 123 comprises the lugs 200 and the bit head region 207 comprises the corresponding grooves as detailed with the embodiment of FIGS. 2 to 5 to provide the bayonet-type retaining formations. Accordingly, drill bit 105 is retained exclusively at assembly 100 via cooperation between the axially forward bayonet retaining formations and the axially rearward screw threads provided at the respective drill bit 105 and drive sub 110. To decouple drill bit 105 from drive sub 110 (where bit 105 is moved to the position of FIG. 11), each lug 200 is allowed to slide axially rearward within each channel 202 and into each channel 401 via each passageway 403. Subsequently, the retaining sleeve 123 may then be decoupled from drive sub 110 via cooperation between respective threads 1000, 1001.

According to all embodiments of FIGS. 2 to 13, drive sub 110 is releaseably mated at the axially forward region of casing 101 via a further set of retaining formations 212, 213. Such further retaining formations may comprise threads provided at the corresponding radially outward facing region of drive sub 110 and radially inward facing region of casing 101. The subject invention is advantageous to allow convenient and rapid interchange of drill bit 105 and/or sleeve 123 at the assembly 100 without a requirement to decouple drive sub 110 from casing 101 (via such further retaining formations) which are common to conventional retaining assemblies. In particular, retaining formations 201 and 1000 are dimensioned radially (having radially inward facing regions that comprise a greater radius than corresponding radially outward facing regions of the drive sub) to allow positioning over at least regions 400, 1001 of the drive sub 110 such that the rearward end 123*b* of sleeve 123 can slide over the past the axially forward end 300 of drive sub 110. Accordingly, sleeve 123 may be coupled and decoupled at drive sub 110 from the forward end of the assembly and not from the opposite rearward end which would otherwise require decoupling of the drive sub 110 from the casing 101.

The invention claimed is:

1. A down-the-hole hammer drill assembly having an axially forward cutting end and an axially rearward attachment end for coupling to a drill string, the assembly comprising:

a drill bit positioned at the cutting end having a cutting head and a shank, a radially outward facing part of the shank including a plurality of first retaining connections;

an elongate casing providing a housing for a piston arranged for shuttling back and forth axially to strike a rearward anvil end of the shank;

an annular drive sub provided at an axially forward end of the casing, the shank being accommodated and extending axially through the drive sub, a radially outward facing part of the drive sub including a plurality of second retaining connections; and a retaining sleeve having a first end positioned over a part of the shank and a second end positioned over a part of the drive sub, the sleeve including a plurality of third and fourth retaining connections at radially inward facing parts to cooperatively engage respectively the first and second plurality of retaining connections to axially couple the drill bit to the drive sub, wherein the first and third retaining connections are configured to disengage one another axially and allow axial decoupling of the drill bit from the sleeve via an axially forward movement of the drill bit relative to drive sub and the second and forth connections are configured to disengage one another axially and allow axial decoupling of the sleeve from the drive sub via an axially forward movement of the sleeve relative to the drive sub,the axial coupling of the drill bit to the drive sub being provided exclusively via the engagement between the respective first and third and second and forth retaining connections.

2. The assembly as claimed in claim 1, wherein a radially outward facing part of the drive sub includes a plurality of fifth retaining connections and a radially inward facing part of the casing includes a plurality of sixth retaining connections that cooperatively engage the fifth retaining connections and releaseably couple axially the drive sub to the casing.

3. The assembly as claimed in claim 2, wherein the axial disengagement of the first and third and the second and forth retaining connections is possible without a requirement to axially decouple the fifth and sixth retaining connections.

4. The assembly as claimed in claim 3, wherein the first and third retaining connections include bayonet connections formed as groove and lug arrangements.

5. The assembly as claimed in claim 4, wherein the second and forth retaining connections include screw threads.

6. The assembly as claimed in claim 5, wherein the drill bit is coupled axially to the drive sub exclusively via abutment between each lug and the closed ends of the respective first channels, and of the first and third connections and between the screw threads of the second and forth connections.

7. The assembly as claimed in claim 4, wherein each groove includes a first axially extending channel being closed at each axial end and a second axially extending channel being closed at a first end and open at a second end, the first and second channels being spaced apart circumferentially and interconnected by a circumferentially extending passageway, each lug being arranged to slide within the passageway and the first and second channels.

8. The assembly as claimed in claim 7, further comprising a plurality of lugs and grooves distributed circumferentially around a longitudinal axis extending through the assembly.

9. The assembly as claimed in claim 7, wherein the drill bit is coupled axially to the drive sub exclusively via abutment between each lug and the closed ends of the respective first channels.

10. The assembly as claimed in claim 3, wherein the second and forth retaining connections include bayonet connections formed as groove and lug arrangements.

11. The assembly as claimed in claim 10, wherein the first and third retaining connections include screw threads.

12. The assembly as claimed in claim 10, wherein each groove includes a first axially extending channel being closed at each axial end and a second axially extending channel being closed at a first end and open at a second end, the first and second channels being spaced apart circumferentially and interconnected by a circumferentially extending passageway, each lug being arranged to slide within the passageway and the first and second channels.

13. The assembly as claimed in claim 1, further comprising a plurality of first splines provided at a radially outward facing region of the shank and a plurality of second splines provided at a radially inward facing region of the drive sub to engage the first splines so as to provide transfer of rotational drive from the drive sub to the drill bit.

14. The assembly as claimed in claim 1, wherein the assembly is devoid of any additional retaining ring positioned radially between the casing and the shank to otherwise axially retain the drill bit at the drive sub.

15. A drilling apparatus for percussive rock drilling comprising:

a drill string formed from a plurality of end-to-end coupled drill tubes; and a drill assembly releaseably attached at an axially forward end of the drill string, the drilling assembly having an axially forward cutting end and an axially rearward attachment end for coupling to a drill string, the assembly including a drill bit positioned at the cutting end having a cutting head and a shank, a radially outward facing part of the shank including a plurality of first retaining connections, an elongate casing providing a housing for a piston arranged for shuttling back and forth axially to strike a rearward anvil end of the shank, an annular drive sub provided at an axially forward end of the casing, the shank being accommodated and extending axially through the drive sub, a radially outward facing part of the drive sub including a plurality of second retaining connections, and a retaining sleeve having a first end positioned over a part of the shank and a second end positioned over a part of the drive sub, the sleeve including a plurality of third and fourth retaining connections at radially inward facing parts to cooperatively engage respectively the first and second plurality of retaining connections to axially couple the drill bit to the drive sub, wherein the first and third retaining connections are configured to disengage one another axially and allow axial decoupling of the drill bit from the sleeve via an axially forward movement of the drill bit relative to drive sub and the second and forth connections are configured to disengage one another axially and allow axial decoupling of the sleeve from the drive sub via an axially forward movement of the sleeve relative to the drive sub, the axial coupling of the drill bit to the drive sub being provided exclusively via the engagement between the respective first and third and second and forth retaining connections.

* * * * *